US012364931B2

(12) United States Patent
Wang et al.

(10) Patent No.: US 12,364,931 B2
(45) Date of Patent: Jul. 22, 2025

(54) ALL-METAL AIRPLANE MODEL

(71) Applicant: Zhengping Wang, Beijing (CN)

(72) Inventors: Zhengping Wang, Beijing (CN); Tianxing Li, Beijing (CN); Wei Wang, Beijing (CN)

(73) Assignee: Zhengping Wang, Beijing (CN)

( * ) Notice: Subject to any disclaimer, the term of this patent is extended or adjusted under 35 U.S.C. 154(b) by 253 days.

(21) Appl. No.: 18/203,675

(22) Filed: May 31, 2023

(65) Prior Publication Data

US 2024/0350934 A1 Oct. 24, 2024

(30) Foreign Application Priority Data

Apr. 18, 2023 (CN) ..... 202320869778.0

(51) Int. Cl.
*A63H 27/00* (2006.01)
*A63H 29/22* (2006.01)

(52) U.S. Cl.
CPC ..... *A63H 27/02* (2013.01); *A63H 27/00* (2013.01); *A63H 29/22* (2013.01)

(58) Field of Classification Search
CPC ..... A63H 27/00; A63H 27/001
See application file for complete search history.

(56) References Cited

U.S. PATENT DOCUMENTS 1,328,134 A * 1/1920 Doelckner ..... A63H 27/00 472/6
1,423,819 A * 7/1922 Shapiro ..... A63H 27/00 446/232
1,507,710 A * 9/1924 Pohlman ..... A63H 27/001 446/30
1,784,633 A * 12/1930 Kraeft ..... A63H 27/001 446/230
2,708,330 A * 5/1955 Ciampolini ..... G09F 23/10 446/67
4,895,541 A * 1/1990 Miller ..... A63H 27/00 446/57
6,688,937 B1 * 2/2004 Tsai ..... A63H 27/02 446/61

* cited by examiner

*Primary Examiner* — John A Ricci
(74) *Attorney, Agent, or Firm* — Bayramoglu Law Offices LLC

(57) ABSTRACT

An all-metal airplane model includes a fuselage, wings, a tail wing, and a power control system, where the power control system is mounted in a wing platform, and the fuselage, the wing, the wing platform and the tail wing are all made of aluminum foil; an end portion of the wing and an end portion of the tail wing each are provided with an end wing structure made of a plastic film; a head of the fuselage, a head of the wing platform or a tail of the wing platform may be provided with a propeller; the tail wing includes a horizontal elevator group mounted at a tail of the fuselage and a vertical steering rudder group mounted above the horizontal elevator group, and the horizontal elevator group and the vertical steering rudder group are both made of aluminum foil.

12 Claims, 5 Drawing Sheets

ALL-METAL AIRPLANE MODEL

CROSS REFERENCE TO THE RELATED APPLICATIONS

This application is based upon and claims priority to Chinese Patent Application No. 202320869778.0, filed on Apr. 18, 2023, the entire contents of which are incorporated herein by reference.

TECHNICAL FIELD

The present disclosure relates to the technical field of aviation models, and in particular, to an all-metal airplane model.

BACKGROUND

An airplane model is a type of aircraft model with strong exploratory properties and is a necessary means of studying aviation science. In addition, its function as a tool for popularizing aviation knowledge and entertainment toys is more prominent.

The airplane model generally has a structure similar to that of an actual airplane, and is mainly composed of a fuselage, wings, a tail wing, a landing gear, a power control system, etc., where the wings are configured to generate a lift force when the airplane model flies, and a dihedral angle design of the wings provides a certain function in lateral stability of the airplane model during flight. The tail wing is composed of a horizontal tail and a vertical tail, where the horizontal tail cooperates with the wings to maintain pitching stability of the airplane model during flight, and the vertical tail cooperates with the wings to maintain directional stability of the airplane model during flight.

Currently, wings and tail wings of most airplane models are made of balsa wood or plastic. The airplane structure made of balsa wood is obtained by manufacturing wing components in advance, bonding the wing components into a whole according to a drawing, and finally covering a surface of the whole with a heat-shrinkable plastic skin. However, the balsa wood material used needs to be imported and has a relatively high cost, and the airplane structure is relatively difficult to manufacture. Once the wing or tail wing structure manufactured is damaged, the wing or tail wing structure needs to be completely replaced, which leads to a higher maintenance cost. In addition, the balsa wood material used for the airplane model cannot be recycled once the airplane model is damaged. A wing or tail wing structure made of plastic is a solid plate made of a blow-molded board or foamed plastic. Although the wing or tail wing structure made of plastic has good workmanship, beautiful appearance and various sizes and models, model components made of plastic need to be manufactured by using a mold, which does not allow airplane model enthusiasts to freely enjoy to their creative abilities. Moreover, during the flight of the airplane model, the plastic airplane itself has low strength, and is easily subjected to breakage and damage during a collision and cannot be repaired again, and the plastic airplane has a relatively high maintenance cost, and is prone to aging over time.

In view of the above shortcomings, there is an urgent need to design an airplane model with a low maintenance cost and high intensity, to ensure that airplane model enthusiasts fully enjoy to their creative abilities.

SUMMARY

In view of the technical problem to be solved, the present disclosure provides an all-metal airplane model, which solves the problems of difficulty in production and high maintenance costs of an existing airplane model, thereby overcoming the shortcomings of the prior art.

To solve the above technical problem, the present disclosure provides an all-metal airplane model, including a fuselage, wings, a tail wing, a propeller, and a power control system, where the wing is designed according to an excellent aerofoil of the airplane model, a wing platform configured to connect the wing is arranged on the fuselage, and the power control system is mounted in the wing platform; the fuselage, the wing, the wing platform and the tail wing are all made of aluminum foil; an end portion of the wing and an end portion of the tail wing each are provided with an end wing structure made of a plastic film, and the end wing structure is configured to prevent the wing and the tail wing from being damaged during a collision; the propeller is mounted at a head of the fuselage, a head of the wing platform or a tail of the wing platform, the tail wing includes a horizontal elevator group mounted at a tail of the fuselage and a vertical steering rudder group mounted above the horizontal elevator group, and the horizontal elevator group and the vertical steering rudder group are both made of aluminum foil.

As an improvement of the present disclosure, the wing has a single-layer cambered surface structure made of aluminum foil, and a surface of the wing is a smooth cambered surface or has a frame structure.

As an improvement of the present disclosure, the wing has a double-layer cambered surface structure made of aluminum foil, the wing includes an upper cambered surface and a lower cambered surface, the upper cambered surface and the lower cambered surface of the wing are formed by integrally rolling aluminum foil according to an aerofoil structure, a rear edge line of the lower cambered surface is tangent to and connected to a middle portion of the upper cambered surface, a hollow cavity is provided between the upper cambered surface and the lower cambered surface, and a smooth cambered surface or a frame structure is used for a part from a rear edge line of the upper cambered surface to a position of the tangent rear edge line of the lower cambered surface.

As a further improvement of the present disclosure, the power control system includes a wireless receiver, an electronic governor, a brushless motor, a servo, and a battery, where the wireless receiver and the electronic governor are fixedly mounted on a middle portion of the fuselage, the wireless receiver is configured to receive a wireless signal transmitted by a remote control device and output a control signal to the electronic governor and the servo, and the electronic governor is configured to adjust a rotating speed of the brushless motor according to the control signal of the wireless receiver; the brushless motor is mounted at the head of the fuselage or the head or the tail of the wing platform, and the propeller is mounted on a driving shaft of the brushless motor; the servo includes an elevator servo and a steering servo, where the elevator servo and the steering servo are both fixed to the tail of the fuselage, and the elevator servo and the steering servo each are connected to the wireless receiver by a signal line; the elevator servo is connected to an elevator surface by a connecting rod, and the elevator servo controls a deflection angle of the elevator surface; the steering servo is connected to a steering rudder surface by a connecting rod, and the steering servo controls a deflection angle of the steering rudder surface; the battery is fixed to the middle portion of the fuselage, and the battery is configured to provide power for the wireless receiver, the brushless motor, and the servo.

As a further improvement of the present disclosure, the horizontal elevator group includes a horizontal stabilizing surface and the elevator surface, where the horizontal stabilizing surface is fixed to the tail of the fuselage, and a front edge line of the elevator surface is hinged to a rear edge line of the horizontal stabilizing surface; the vertical steering rudder group includes a vertical stabilizing surface and a steering rudder surface, where the vertical stabilizing surface is vertically and fixedly connected to an upper surface of the horizontal stabilizing surface, and a front edge line of the steering rudder surface is hinged to a rear edge line of the vertical stabilizing surface.

As a further improvement of the present disclosure, a smooth flat plate structure or a frame structure made of aluminum foil is used for each of the horizontal stabilizing surface, the vertical stabilizing surface, the elevator surface and the steering rudder surface.

As a further improvement of the present disclosure, at least one layer of plastic film is attached to a surface of the frame structure.

As an improvement of the present disclosure, the fuselage has a solid thin rod-shaped structure, the fuselage is made of carbon fiber, the middle portion of the fuselage is provided with an I-shaped connecting member, the wing is fixed to an upper portion of the fuselage by the connecting member, and the wireless receiver and the electronic governor in the power control system are fixedly connected to a side of the connecting member.

As an improvement of the present disclosure, the fuselage includes a plurality of sections of hollow tubular structures that are sequentially in inserted connection with each other, junctions of adjacent tubular structures each are provided with a connecting adhesive tape for fixing, a wing platform structure configured to connect the wing is fixedly arranged on the middle portion of the fuselage, and the wing is connected to the fuselage by the wing platform; and the wireless receiver and the electronic governor in the power control system are fixedly mounted inside the wing platform.

As an improvement of the present disclosure, a truss structure is used for the fuselage, the truss structure includes a front truss portion, a middle truss portion and a rear truss portion that are integrally connected to each other, an upper portion of the middle truss portion is fixedly connected to the wing, and the wireless receiver and the electronic governor in the power control system are mounted inside the middle truss portion.

With such a design, the present disclosure has at least the following advantages:

(1) In the airplane model according to the present disclosure, conventional balsa wood or plastic is replaced with metal thin aluminum sheets, so that the airplane model is more convenient to maintain, and model components are more convenient to manufacture; and the airplane model made of the metal thin aluminum sheets has better strength than a balsa wood or plastic structure, and is more suitable for innovation by airplane model enthusiasts. In addition, in the airplane model, weights of the wing and the tail wing may be reduced. By arranging the wing or the tail wing as a frame structure to which a plastic film is attached, the weight of the airplane model is greatly reduced, thereby reducing flight energy consumption and improving endurance.

(2) The airplane model according to the present disclosure may have atypical aerodynamic configuration structure, such as orthodox configuration, canard configuration, blended-wing-body configuration and flying-wing configuration, or may have a hydroplane configuration structure. On this basis, the airplane model according to the present disclosure improves the aerodynamic performance. Because the wings made of aluminum foil are used in the airplane model and the surfaces of the wings are symmetrical, smooth and good in consistency, the air resistance of the wings is small, and a lift force can be enhanced, which makes a lift-drag ratio increase. The tail wing part made of aluminum foil is thinner and smoother than a tail wing made of plastic or wood when the rigidity is ensured, so the resistance to the tail wing is smaller, and the lift-drag ratio of the entire airplane is increased. In addition, because the tail wing is lighter, the corresponding steering rudder surface and elevator surface are more flexible to operate.

(3) The airplane model made of aluminum foil in the present disclosure has a simple manufacturing process. Because most structures of the airplane model are made of aluminum foil, it is convenient to obtain materials, such as aluminum cans, which can be obtained in rural areas and towns, and it is more convenient to promote and perform flight model manufacturing. In addition, the airplane model made of plastic or wood is easily subjected to aging. After the plastic airplane is weathered, its surface becomes rough, and the resistance to the airplane increases. Besides, the airplane model becomes brittle or deformed, which affects a flight state. After the wooden airplane model is wetted, parts of the model used may also be deformed, which affects overall performance of the airplane model. Compared with the above materials, the airplane model made of aluminum foil in the present disclosure better facilitates storage, maintenance and repair.

(4) The airplane model according to the present disclosure is made of aluminum foil, which has a unique metallic luster, so that the shape of the airplane model is closer to that of a real airplane. In addition, conventional plastic airplane models are all chemical products during production. Therefore, pollution is prone to occur during production, and the environment is also affected after the airplane is scrapped. Because the wooden airplane model needs to be made of balsa wood, its cost is high, and the wooden airplane model is difficult to recycle after being scrapped, which also pollutes the environment. Comparatively, the airplane model made of aluminum foil in this embodiment can be recycled, thereby having less environmental pollution.

BRIEF DESCRIPTION OF THE DRAWINGS

The above is only an overview of the technical solutions of the present disclosure. In order to understand the technical means of the present disclosure more clearly, the present disclosure will be further described in detail below with reference to the accompanying drawings and specific implementations.

REFERENCE NUMERALS IN THE DRAWINGS

Figure 1:
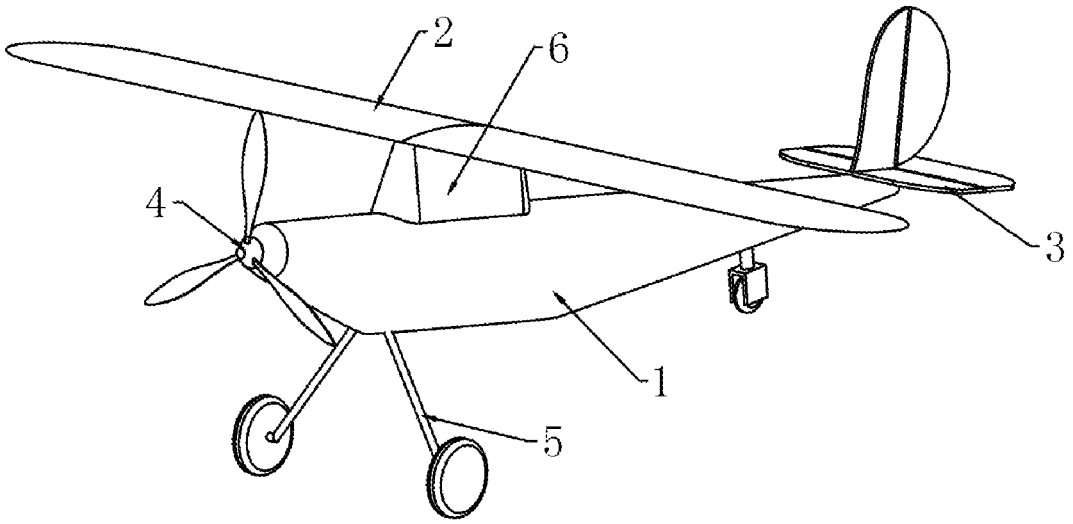
FIG. 1 is a schematic diagram of an overall structure of an airplane model according to an embodiment of the present disclosure.

1—Fuselage; 2—Wing; 21—End wing structure; 22—Upper cambered surface; 23—Lower cambered surface; 24—Cambered leading edge; 25—Hollow cavity; 3—Tail wing; 31—Horizontal stabilizing surface; 32—Elevator surface; 33—Vertical stabilizing surface; 34—Steering rudder surface; 4—Propeller; 5—Landing gear; 6—Wing platform.

DETAILED DESCRIPTION OF THE EMBODIMENTS

Examples of the embodiments of the present disclosure are shown in the accompanying drawings. The same or similar reference numerals represent the same or similar components or components having the same or similar functions throughout. The embodiments described below with reference to the accompanying drawings are exemplary, are used only for explaining the present disclosure, and should not be construed as a limitation to the present disclosure.

In the description of the present disclosure, it should be noted that, unless otherwise clearly specified, meanings of terms "mount", "connected", and "connect" should be understood in aboard sense. For example, the term may be a fixed connection, a removable connection, or an integral connection; may be a mechanical connection or an electrical connection; and may be a direct connection, an indirect connection by using an intermediate medium, or internal communication between two components. Those of ordinary skill in the art may understand specific meanings of the above terms in the present disclosure based on a specific situation.

Embodiment

As shown in FIG. 1, this embodiment specifically discloses an all-metal airplane model, which includes wings 2, fuselage 1, tail wing 3, power control system, and landing gear 5.

The airplane model in this embodiment has atypical aerodynamic configuration structure, such as orthodox configuration, canard configuration, blended-wing-body configuration and flying-wing configuration, or may have a hydroplane configuration structure. On this basis, the airplane model in this embodiment improves the aerodynamic performance. The wing 2 in this embodiment has an aerofoil structure, and a wing platform 6 configured to connect the wing is arranged on the fuselage 1. The power control system is mounted in the wing platform 6. The fuselage 1, the wing 2, the wing platform 6 and the tail wing 3 are all made of aluminum foil. An end portion of the wing 2 and an end portion of the tail wing 3 each are provided with an end wing structure 21 made of a plastic film, and the end wing structure 21 is configured to prevent the wing 2 and the tail wing 3 from being damaged during a collision. The aerofoil structure used for the wing 2 in this embodiment is improved on the basis of a universal aerofoil of an ordinary airplane model. The wing 2 and the tail wing 3 are both made of aluminum foil. The end portion of the wing 2 and the end portion of the tail wing 3 each are provided with the end wing structure 21 made of the plastic film, and the end wing structure 21 is mainly configured to protect the wing and the tail wing. Since the wing and the tail wing in this embodiment are made of metal aluminum foil, an edge end portion of the wing and an edge end portion of the tail wing are relatively light, thin and sharp. When a collision occurs, the edge end portion of the wing and the edge end portion of the tail wing are very easily subjected to damage, or even cause personal injury. In order to solve this problem, in this embodiment, the end wing structure 21 made of the plastic film is bonded and fixed to each of the edge end portion of the wing and the edge end portion of the tail wing, and buffering is performed by using the flexible end wing structure 21, which can prevent damage to the edge end portion of the wing and the edge end portion of the tail wing, and can also prevent personal damage. In this embodiment, since the wing 2 and the tail wing 3 are made of aluminum foil, the wing and the tail wing are more convenient to manufacture and are more suitable for airplane model enthusiasts. Since the aluminum foil is malleable and has a certain strength, the aluminum foil is more in line with the wing 2 and the tail wing 3 for manufacturing the airplane model, and enables the airplane model enthusiasts to give play to their creativity. Moreover, when the wing 2 and the tail wing 3 made of the aluminum foil are used for the airplane model, once the wing 2 or the tail wing 3 is damaged during flight, damaged parts can be repaired without replacing the parts, which better facilitates airplane model maintenance. In addition, the wing 2 and the tail wing 3 made of the aluminum foil further have other advantages. For example, the wing or the tail wing made of plastic or balsa wood is generally relatively thick due to manufacturing and strength requirements for the airplane model, so that the overall resistance to the airplane model is relatively high, and some power needs to be consumed during flight to overcome the overall resistance to the airplane model. As a result, the energy consumption is relatively high. In this embodiment, the wing or the tail wing made of the aluminum foil is lighter and thinner, so that the overall resistance to the airplane model is relatively small, and thus the energy consumption during flight is relatively low. Of course, it should be noted that the fuselage 1, the wing 2, the wing platform 6 and the tail wing 3 in this embodiment are all preferably made of aluminum foil, but other metal materials are not excluded. For example, copper foil, etc. may also be used.

Figure 2:
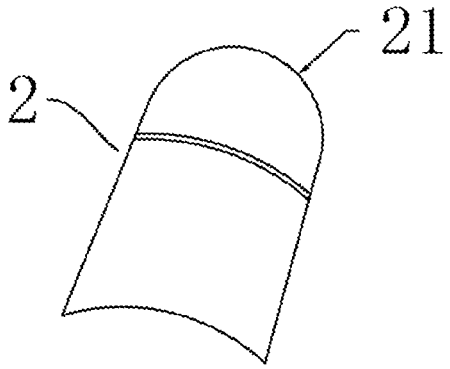
FIG. 2 is a schematic structural diagram of a single-layer cambered wing with a smooth cambered surface in an airplane model according to an embodiment of the present disclosure.
Figure 3:
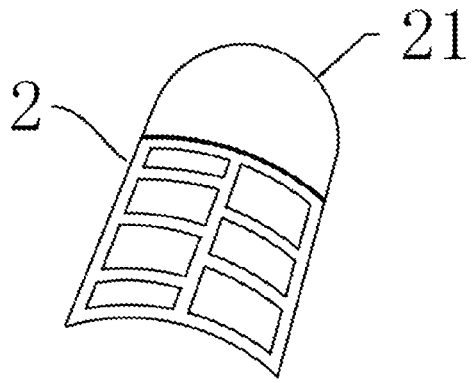
FIG. 3 is a schematic structural diagram of a single-layer cambered wing with a frame structure in an airplane model according to an embodiment of the present disclosure.

Specifically, as shown in FIGS. 2 and 3, the wing 2 in this embodiment has a single-layer cambered surface structure made of aluminum foil, and a surface of the wing 2 is a smooth cambered surface or has a frame structure. As shown in FIG. 2, the single-layer cambered wing 2 with a smooth cambered surface is made of a whole piece of aluminum foil, and air can flow across the surface of the wing 2 during flight to provide a lift force for the airplane model; or as shown in FIG. 3, the surface of the wing 2 has a frame structure, a layer of plastic film is tightly attached to the surface of the frame structure, and air flows across the surface of the film during flight. This structure does not affect the air flow on the surface of the wing, and can further reduce the weight of the wing and reduce flight energy consumption. The frame structure of the wing 2 in this embodiment can be formed by cutting the surface of the aluminum foil and reserving an aluminum rectangular frame.

Figure 4:
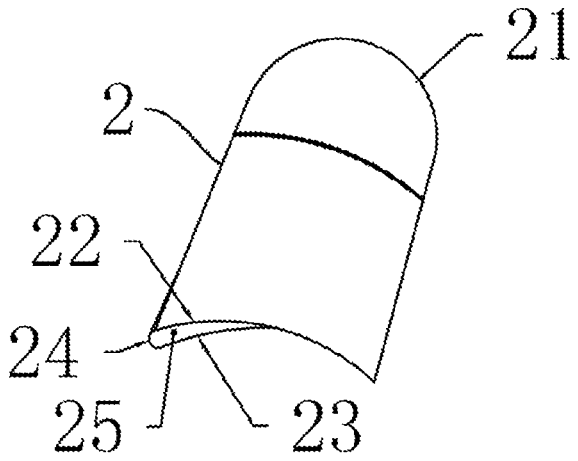
FIG. 4 is a schematic structural diagram of a double-layer cambered wing with a smooth cambered surface in an airplane model according to an embodiment of the present disclosure.
Figure 5:
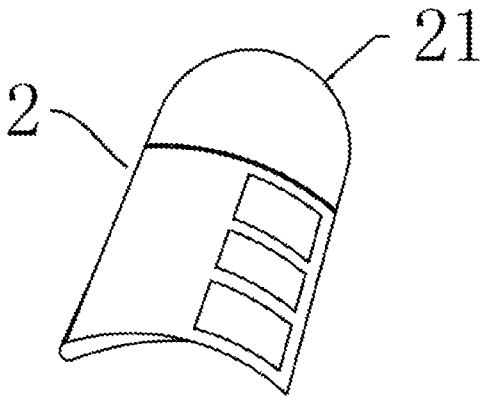
FIG. 5 is a schematic structural diagram of a double-layer cambered wing with a frame structure in an airplane model according to an embodiment of the present disclosure.

As another alternative structure, this embodiment further discloses wing 2 with a double-layer cambered surface structure made of aluminum foil. As shown in FIGS. 4 and 5, the wing 2 includes upper cambered surface 22 and lower cambered surface 23. The upper cambered surface 22 and the lower cambered surface 23 of the wing 2 are formed by integrally rolling aluminum foil according to an aerofoil structure, a rear edge line of the lower cambered surface 23 is tangent to and connected to a middle portion of the upper cambered surface 22, hollow cavity 25 is provided between the upper cambered surface 22 and the lower cambered surface 23, and a smooth cambered surface or a frame structure is used for a part from a rear edge line of the upper cambered surface 22 to a position of the tangent rear edge line of the lower cambered surface 23. As shown in FIG. 4, cambered leading edge 24 of the wing 2 in the above structure can enhance the structural strength of the wing. Compared with the wing 2 with a single-layer cambered surface structure, the wing 2 with the above structure has better impact resistance, and is more stable during flight. It should be noted that the upper cambered surface 22 and the lower cambered surface 23 of the above wing 2 with the double-layer cambered surface structure and the cambered leading edge 24 of the wing 2 are formed by rolling the same piece of aluminum foil. Therefore, the wing has a smoother surface, and the airflow disturbance is smaller when air flows into the surface of the wing. Alternatively, in the wing 2 with the double-layer cambered surface structure in this embodiment, a frame structure may be further used for the part from the rear edge line of the upper cambered surface 22 to the position of the tangent rear edge line of the lower cambered surface 23. As shown in FIG. 5, at least one layer of plastic film is tightly attached to a surface of the frame structure. In this structure, by arranging part of the structure of the wing 2 as a frame, the overall weight of the airplane model can be reduced to a largest extent, thereby reducing the power consumption of the airplane model and prolonging the endurance. In addition, in order to ensure the stable passage of airflow at the wing 2, a layer of plastic film is tightly attached to the surface of the frame structure of the wing 2 to stabilize the airflow of the wing 2 of the airplane model.

The tail wing 3 in this embodiment includes a horizontal elevator group mounted at a tail of the fuselage 1 and a vertical steering rudder group mounted above the horizontal elevator group, and the horizontal elevator group and the vertical steering rudder group are both made of aluminum foil. The horizontal elevator group includes horizontal stabilizing surface 31 and elevator surface 32, the horizontal stabilizing surface 31 is fixed to the tail of the fuselage 1, and a front edge line of the elevator surface 32 is hinged to a rear edge line of the horizontal stabilizing surface 31; the vertical steering rudder group includes vertical stabilizing surface 33 and steering rudder surface 34, where the vertical stabilizing surface 33 is vertically and fixedly connected to an upper surface of the horizontal stabilizing surface 31, and a front edge line of the steering rudder surface 34 is hinged to a rear edge line of the vertical stabilizing surface 33.

Figure 6:
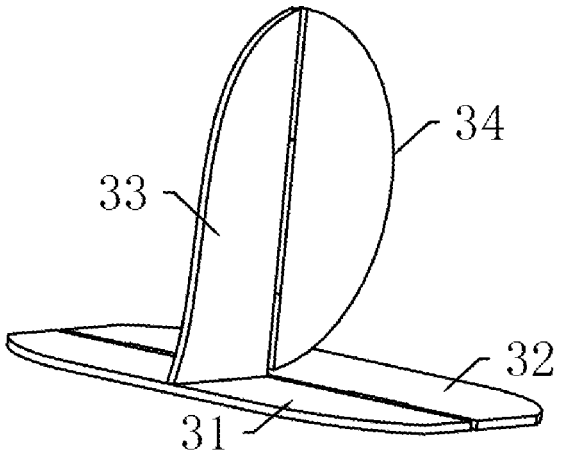
FIG. 6 is a schematic structural diagram of a tail wing with a smooth flat plate structure in an airplane model according to an embodiment of the present disclosure.
Figure 7:
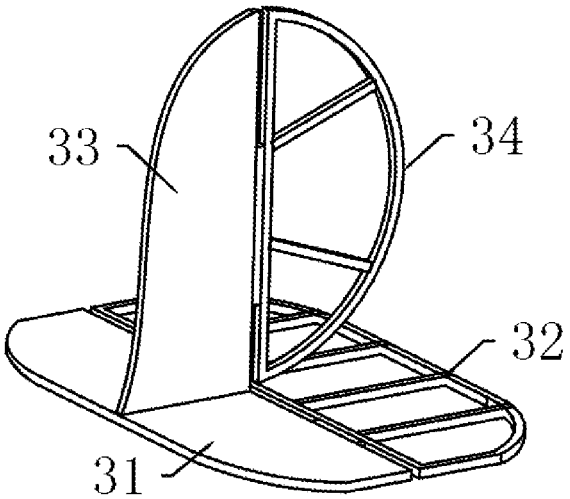
FIG. 7 is a schematic structural diagram of a tail wing with a smooth flat plate combined with a frame structure in an airplane model according to an embodiment of the present disclosure.
Figure 8:
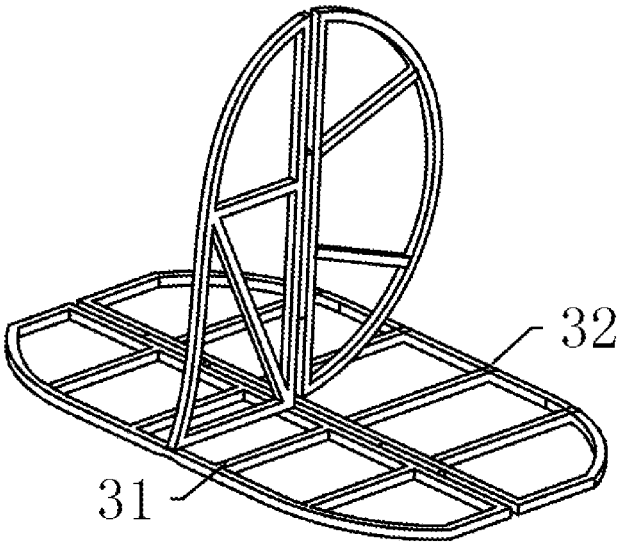
FIG. 8 is a schematic structural diagram of a tail wing with a frame structure in an airplane model according to an embodiment of the present disclosure.

As shown in FIG. 6, a smooth flat structure made of aluminum foil may be used for each of the horizontal stabilizing surface 31, the vertical stabilizing surface 33, the elevator surface 32 and the steering rudder surface 34 in this embodiment. The aluminum tail wing 3 structure not only is light in weight, but also can maintain a certain strength, and can meet functional requirements for the tail wing 3 in the airplane model. Moreover, based on the malleability characteristics of metal aluminum foil, the tail wing 3 of the airplane model is more convenient to maintain and repair when damaged. As another alternative structure, as shown in FIG. 8, a frame structure made of aluminum foil may be further used for each of the horizontal stabilizing surface 31, the vertical stabilizing surface 33, the elevator surface 32 and the steering rudder surface 34 in this embodiment, and a layer of plastic film is attached to a surface of the corresponding frame structure, so that the weight of the tail wing 3 with the frame structure is greatly reduced. In addition, the plastic film with a relatively light weight and a smooth surface is used as the surface structure of the tail wing 3, which improves the handling stability of the tail wing 3. Of course, the horizontal stabilizing surface 31, the vertical stabilizing surface 33, the elevator surface 32 and the steering rudder surface 34 in this embodiment may combine a smooth flat plate structure and a frame structure made of aluminum foil. As shown in FIG. 7, for example, a smooth flat plate structure is used for each of the horizontal stabilizing surface 31 and the vertical stabilizing surface 33, while a frame structure with a plastic film attached is used for each of the elevator surface 32 and the steering rudder surface 34. Since the self-weights of the elevator surface 32 and the steering rudder surface 34 are reduced, a servo can control deflection of the elevator surface 32 and the steering rudder surface 34 more easily. Further, flexible connecting fabrics may be used between the horizontal stabilizing surface 31, the elevator surface 32, the vertical stabilizing surface 33 and the steering rudder surface 34 in this embodiment for connection. For example, flexible connecting fabrics are bonded to connection edges of the horizontal stabilizing surface 31 and the elevator surface 32 respectively, or flexible connecting fabrics are clamped and connected by the double-layer horizontal stabilizing surface 31 and the elevator surface 32 respectively, or another manner is used, so that a connection relationship between the horizontal stabilizing surface 31 and the elevator surface 32 is maintained, and the horizontal stabilizing surface and the elevator surface can be easily bent. Similarly, the above structure may also be used between the vertical stabilizing surface 33 and the steering rudder surface 34.

The power control system is mounted in the wing platform 6. The power control system includes a wireless receiver, an electronic governor, a brushless motor, a servo, and a battery, where the wireless receiver and the electronic governor are fixedly mounted on a middle portion of the fuselage 1, the wireless receiver is configured to receive a wireless signal transmitted by a remote control device and output a control signal to the electronic governor and the servo, and the electronic governor is configured to adjust a rotating speed of the brushless motor according to the control signal of the wireless receiver; the brushless motor is mounted at the head of the fuselage 1, a propeller 4 is mounted at the head of the fuselage 1, the head of the wing platform 6 or the tail of the wing platform 6, and the propeller 4 is mounted on a driving shaft of the brushless motor; the servo includes an elevator servo and a steering servo, where the elevator servo and the steering servo are both fixed to the fuselage 1, and the elevator servo and the steering servo each are connected to the wireless receiver by a signal line; the elevator servo is connected to the elevator surface 32 by a connecting rod, and the elevator servo controls a deflection angle of the elevator surface 32; the steering servo is connected to the steering rudder surface 34 by a connecting rod, and the steering servo controls a deflection angle of the steering rudder surface 34; the battery is fixed to the middle portion of the fuselage 1, and the battery is configured to provide power for the wireless receiver, the brushless motor, and the servo.

Figure 9:
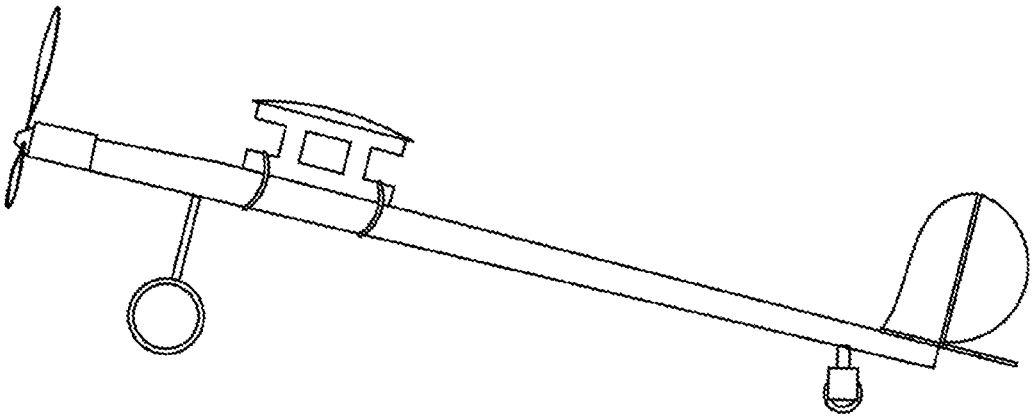
FIG. 9 is a schematic structural diagram of a thin rod-shaped fuselage in an airplane model according to an embodiment of the present disclosure.

Further, the fuselage 1 in this embodiment serves as a main load-bearing structure of the airplane model, and the strength of the fuselage affects the overall strength of the airplane model. The fuselage 1 in this embodiment may have a solid thin rod-shaped structure. As shown in FIG. 9, the middle portion of the fuselage 1 is provided with an I-shaped connecting member, the wing 2 is fixed to an upper portion of the fuselage 1 by the connecting member, and the wireless receiver and the electronic governor in the power control system are fixedly connected to a side of the connecting member. The brushless motor is fixed to the head of the thin rod-shaped fuselage 1; and the tail wing 3 is fixed to a rear end of the fuselage 1.

Figure 10:
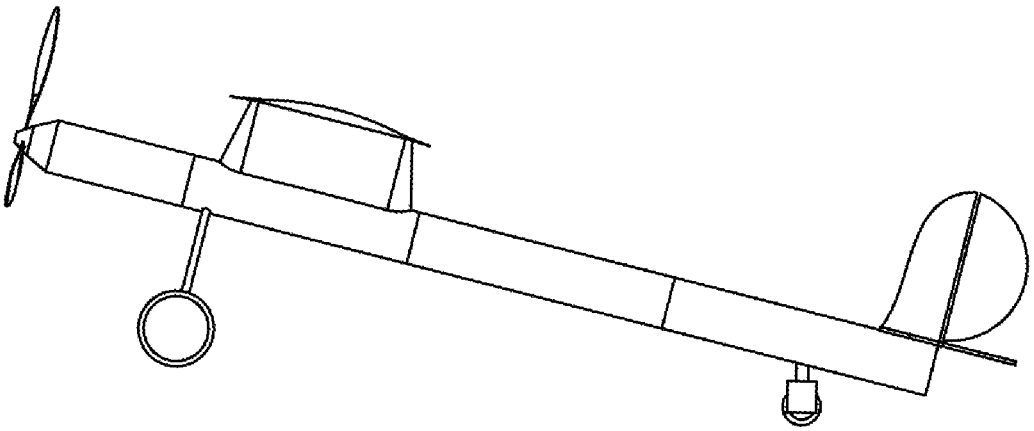
FIG. 10 is a schematic structural diagram of a tubular fuselage in an airplane model according to an embodiment of the present disclosure.

Further, as an alternative, the fuselage 1 in this embodiment may include a plurality of sections of hollow tubular structures. As shown in FIG. 10, the fuselage 1 in this embodiment uses the plurality of sections of hollow tubular structures for inserted connection, and the length of the fuselage 1 with this structure can be determined by combination at will, which better facilitates fuselage assembly. In addition, the wing platform configured to connect the wing 2 is fixedly arranged on the middle portion of the fuselage 1 in this embodiment. Further, the wing platform 6 may be connected to one section of tubular structure, and the wing 2 is connected to the fuselage 1 by the wing platform 6. The wireless receiver and the electronic governor in the power control system are fixedly mounted inside the wing platform 6 to prevent a line from shaking and dropping due to the influence of airflow during flight. In addition, the brushless motor is fixed to the tubular structure located at the head of the fuselage 1, while the tail wing 3 is fixed to the tubular structure located at the rear end of the fuselage 1. The airplane model with the above fuselage structure can better serve as an experimental platform of airplane models. The airplane model enthusiasts often modify airplane models to obtain excellent flight performance or handling performance, but a fuselage of an airplane model with a conventional structure cannot be disassembled or adjusted at will, while the fuselage with the plurality of sections of hollow tubular structures has the advantage of arbitrarily adjustment of the length of the fuselage. The length of the fuselage can be changed by increasing or reducing a number of tubular structures, and the fuselage can be assembled by simple insertion and pulling, thereby making the disassembly and assembly more convenient without disassembling structures such as the wing, the propeller and the tail wing. In addition, in order to further improve the connection strength between adjacent tubular structures, a round of fixing adhesive tape may adhere to a joint of the adjacent tubular structures for fixing. During disassembly, the fixing adhesive tape is torn off, so that the adjacent tubular structures can be disassembled.

Figure 11:
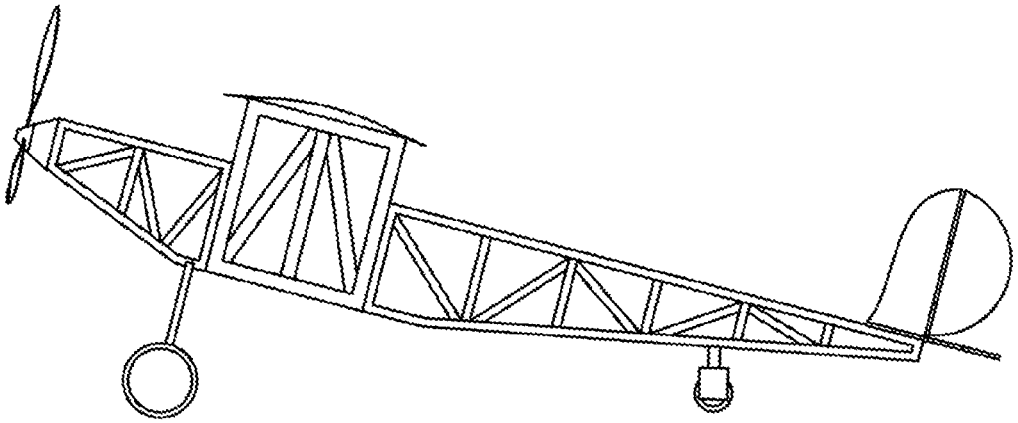
FIG. 11 is a schematic structural diagram of a fuselage with a truss structure in an airplane model according to an embodiment of the present disclosure.

As another alternative, a truss structure may be used for the fuselage 1 in this embodiment. As shown in FIG. 11, specifically, the truss structure includes a front truss portion, a middle truss portion and a rear truss portion that are integrally connected to each other, where an upper portion of the middle truss portion is fixedly connected to the wing 2, and the wireless receiver and the electronic governor in the power control system are mounted inside the middle truss portion. Similarly, the brushless motor is fixed to the front truss portion of the fuselage 1, and the tail wing 3 is fixed to the rear truss portion of the fuselage 1. The truss structure can further enhance the strength of the fuselage 1 to ensure structural stability of the entire airplane model.

The landing gear 5 in this embodiment includes two groups of front landing gears 5 and one group of rear landing gears 5, and the front landing gears 5 and the rear landing gears 5 jointly support the airplane model to ensure the stability of takeoff or landing of the airplane model.

The above are only preferred embodiments of the present disclosure, and are not intended to limit the present disclosure in any form. Simple alterations, equivalent changes or modifications made by those skilled in the art using the technical contents disclosed above fall within the scope of protection of the present disclosure.

What is claimed is:

1. An all-metal airplane model, comprising a fuselage, wings, a tail wing, a propeller, and a power control system, wherein each wing is designed according to an excellent aerofoil of the all-metal airplane model, and a wing platform configured to connect each wing is arranged on the fuselage;

the fuselage, the wings, the wing platform and the tail wing are made of aluminum foil;

an end portion of each wing and an end portion of the tail wing each are provided with an end wing structure made of a plastic film, and the end wing structure is configured to prevent the wings and the tail wing from being damaged during a collision; and the propeller is mounted at a head of the fuselage, a head of the wing platform or a tail of the wing platform, the tail wing comprises a horizontal elevator group mounted at a tail of the fuselage and a vertical steering rudder group mounted above the horizontal elevator group, and the horizontal elevator group and the vertical steering rudder group are made of aluminum foil.

2. The all-metal airplane model according to claim 1, wherein each wing has a single-layer cambered surface structure made of aluminum foil, and a surface of each wing is a smooth cambered surface or has a frame structure.

3. The all-metal airplane model according to claim 2, wherein at least one layer of plastic film is attached to a surface of the frame structure.

4. The all-metal airplane model according to claim 1, wherein the each has a double-layer cambered surface structure made of aluminum foil, each wing comprises an upper cambered surface and a lower cambered surface, the upper cambered surface and the lower cambered surface of each wing is formed by integrally rolling aluminum foil according to an aerofoil structure, a rear edge line of the lower cambered surface is tangent to and connected to a middle portion of the upper cambered surface, a hollow cavity is provided between the upper cambered surface and the lower cambered surface, and a smooth cambered surface or a frame structure is configured for a part from a rear edge line of the upper cambered surface to a position of the tangent rear edge line of the lower cambered surface.

5. The all-metal airplane model according to claim 4, wherein at least one layer of plastic film is attached to a surface of the frame structure.

6. The all-metal airplane model according to claim 1, wherein the power control system comprises a wireless receiver, an electronic governor, a brushless motor, a servo, and a battery, wherein the wireless receiver and the electronic governor are fixedly mounted on a middle portion of the fuselage, the wireless receiver is configured to receive a wireless signal transmitted by a remote control device and output a control signal to the electronic governor and the servo, and the electronic governor is configured to adjust a rotating speed of the brushless motor according to the control signal of the wireless receiver;

the brushless motor is mounted at the head of the fuselage, the head of the wing platform or the tail of the wing platform, and the propeller is mounted on a driving shaft of the brushless motor;

the servo comprises an elevator servo and a steering servo, wherein the elevator servo and the steering servo are fixed to the tail of the fuselage, and the elevator servo and the steering servo each are connected to the wireless receiver by a signal line;

the elevator servo is connected to an elevator surface by a first connecting rod, and the elevator servo controls a deflection angle of the elevator surface;

the steering servo is connected to a steering rudder surface by a second connecting rod, and the steering servo controls a deflection angle of the steering rudder surface; and the battery is fixed to the middle portion of the fuselage, and the battery is configured to provide power for the wireless receiver, the brushless motor, and the servo.

7. The all-metal airplane model according to claim 6, wherein the fuselage has a solid thin rod-shaped structure, the fuselage is made of carbon fiber, the middle portion of the fuselage is provided with an I-shaped connecting member, each wing is fixed to an upper portion of the fuselage by the I-shaped connecting member, and the wireless receiver and the electronic governor in the power control system are fixedly connected to a side of the I-shaped connecting member.

8. The all-metal airplane model according to claim 6, wherein the fuselage comprises a plurality of sections of hollow tubular structures, the plurality of sections of hollow tubular structures are sequentially in inserted connection with each other, junctions of adjacent hollow tubular structures each are provided with a connecting adhesive tape for fixing, a wing platform structure configured to connect each wing is fixedly arranged on the middle portion of the fuselage, and each wing is connected to the fuselage by the wing platform; and the wireless receiver and the electronic governor in the power control system are fixedly mounted inside the wing platform.

9. The all-metal airplane model according to claim 6, wherein a truss structure is configured for the fuselage, the truss structure comprises a front truss portion, a middle truss portion and a rear truss portion, wherein the front truss portion, the middle truss portion and the rear truss portion are integrally connected to each other, an upper portion of the middle truss portion is fixedly connected to each wing, and the wireless receiver and the electronic governor in the power control system are mounted inside the middle truss portion.

10. The all-metal airplane model according to claim 1, wherein the horizontal elevator group comprises a horizontal stabilizing surface and an elevator surface, wherein the horizontal stabilizing surface is fixed to the tail of the fuselage, and a front edge line of the elevator surface is hinged to a rear edge line of the horizontal stabilizing surface; and the vertical steering rudder group comprises a vertical stabilizing surface and a steering rudder surface, wherein the vertical stabilizing surface is vertically and fixedly connected to an upper surface of the horizontal stabilizing surface, and a front edge line of the steering rudder surface is hinged to a rear edge line of the vertical stabilizing surface.

11. The all-metal airplane model according to claim 10, wherein a smooth flat plate structure or a frame structure made of aluminum foil is configured for each of the horizontal stabilizing surface, the vertical stabilizing surface, the elevator surface and the steering rudder surface.

12. The all-metal airplane model according to claim 11, wherein at least one layer of plastic film is attached to a surface of the frame structure.

* * * * *